US010767240B2

(12) United States Patent
Chung

(10) Patent No.: US 10,767,240 B2
(45) Date of Patent: Sep. 8, 2020

(54) COOLANT SPRAY MODULE SYSTEM FOR HEAT TREATED METAL PRODUCT

(71) Applicant: DAEWON APPLIED ENG. CO., Siheung-si, Gyeonggi-do (KR)

(72) Inventor: Chan-Ki Chung, Incheon (KR)

(73) Assignee: DAEWON APPLIED ENG. CO., Siheung-si, Gyeonggi-Do (KR)

( * ) Notice: Subject to any disclaimer, the term of this patent is extended or adjusted under 35 U.S.C. 154(b) by 5 days.

(21) Appl. No.: 16/296,905

(22) Filed: Mar. 8, 2019

(65) Prior Publication Data

US 2020/0032361 A1 Jan. 30, 2020

(30) Foreign Application Priority Data

Jul. 26, 2018 (KR) ..... 10-2018-0086947

(51) Int. Cl.
*C21D 1/667* (2006.01)
*B05B 1/14* (2006.01)

(52) U.S. Cl.
CPC ..... *C21D 1/667* (2013.01); *B05B 1/14* (2013.01)

(58) Field of Classification Search
CPC ..... C21D 1/667; B05B 1/14; B21C 9/00
USPC ..... 266/113, 114
See application file for complete search history.

(56) References Cited

U.S. PATENT DOCUMENTS 6,605,250 B1 * 8/2003 Reiso ..... C21D 9/0075 266/114
2020/0032361 A1 * 1/2020 Chung ..... B21B 45/0233

FOREIGN PATENT DOCUMENTS

| | | | |
|---|---|---|---|
| KR | 10-0755273 | B | 9/2007 |
| KR | 10-1342402 | B | 1/2014 |
| KR | 10-1401021 | B | 5/2014 |
| KR | 10-2014-0122543 | A | 10/2014 |
| KR | 10-2016-0041996 | A | 4/2016 |

* cited by examiner

*Primary Examiner* — Scott R Kastler
(74) *Attorney, Agent, or Firm* — Novick, Kim & Lee, PLLC; Jae Youn Kim

(57) ABSTRACT

Provided is a coolant spray module system for a heat treatment metal product, comprising: a first coolant spray module (1A), wherein the first coolant spray module (1A) comprises a first module housing (10), a first module cover (20), and a first nozzle (30), wherein the first nozzle (30) is fixed between the first module housing (10) and the first module cover (20) by first nozzle fixing blocks (13) and second nozzle fixing blocks (23), wherein the coolant spray module system sprays the coolant onto the heat treatment metal product to quench and clean the heat treatment metal product.

5 Claims, 7 Drawing Sheets

COOLANT SPRAY MODULE SYSTEM FOR HEAT TREATED METAL PRODUCT

TECHNICAL FIELD

The present invention relates to a coolant spray module system for quenching a metal product, which is heated to a high temperature during a heat treatment process, thereby improving physical properties of the metal product.

More specifically, the coolant spray module system for a heat treated metal product injects a coolant from a nozzle onto the metal product to quench and clean the heat-treated metal product. The nozzle is in a disc shape with a hollow center and fixed to a nozzle fixing block of a coolant distribution pipe.

According to this system, the coolant spray module system includes a module housing and a module cover. A passing hole through which the product passes is formed at the center of the coolant spray module system. A coolant distribution pipe filled with coolant is formed around the passing hole.

TECHNICAL BACKGROUND

Generally, a heat treatment process for controlling a heating or cooling rate is performed to improve characteristics of a metal product. Quenching is referred to a process of quickly cooling down a metal product, which is heated to a high temperature by heat treatment, to cause its metal structure undergo a phase change. The quenching process is performed by spraying a coolant such as oil onto the surface of the metal product.

Korean Patent Publication No. 10-2016-0041996 (published on Jun. 18, 2018) proposes a device for spraying coolant as a quenching system for heat treatment metal products.

This system discloses a conical nozzle. An outer ring and an inner ring are engaged with each other to form an inclined inner engagement surface. An opening is formed in the inclined inner engagement surface through which the product passes.

Further, at least one quenching ring is provided to adjust a distance between the outer ring and the inner ring using a fastener. Due to such adjustment, a shape and a size of the nozzle can change, thereby adjusting a flow rate of the coolant sprayed out.

A ring plenum is formed in the quenching ring to receive the coolant supplied from the outside. The nozzles are connected to the ring plenum. In the conventional quenching system, the coolant is injected into the nozzles at the same pressure with each other regardless of the location of nozzles. That is, injection pressure of the coolant is the same regardless of the location of nozzles.

However, the pressures of the coolant sprayed out are different from each other depending on the location of the nozzles due to the influence of gravity. For example, a nozzle located at the top of the ring plenum is different from a nozzle located at the bottom of the ring plenum in the spray pressures of the coolant. Due to such difference, the surface of the metal product is quenched uniformly.

Furthermore, the nozzles are integrated with the quenching ring to form a single body. Thus, it is impossible to adjust a spraying angle of the coolant.

The conventional method adjusts the interval between the outer ring and the inner ring using the fastener and control the amount of the coolant sprayed out. However, it is difficult to precisely control the injection amount of the coolant with such method. Thus, there is a limitation in controlling the cooling rate of the product. For related conventional art, see Korean Patent Publication No. 10-2016-0041996 (published on Apr. 18, 2016).

DETAILED DESCRIPTION

Problems to be Solved

An objective of the present invention is to prevent a coolant from randomly spraying out in an unintended direction away a coolant spray module. As a result, uneven cooling of a working product can be prevented.

Another objective of an embodiment of the present invention is to uniformly cool down the working product. For this purpose, an injection pressure of a coolant sprayed from an upper nozzle is maintained as same as an injection pressure of a coolant sprayed from a lower nozzle, thereby neutralizing the gravity effect which differently applies to the nozzles depending on location.

Another objective of an embodiment of the present invention is to provide a coolant spray module capable of easily controlling injection angles and spray amounts of the coolant.

In an embodiment of the present invention, the sprayed coolant splashes out of the coolant spray module, thereby preventing the occurrence of uneven cooling of the product surface.

Another objective of the present invention is to prevent uneven cooling of a working product. The uneven cooling may occur when a coolant randomly sprays out in an unintended direction away a coolant spray module.

Solution to Solve the Problem

A coolant spray module system for a heat treatment metal product according to an embodiment of the present invention, includes a first coolant spray module (1A). The first coolant spray module (1A) comprises a first module housing (10), a first module cover (20), and a first nozzle (30). The first module housing (10) comprises: a first passing hole (11) provided in the first module housing (10), wherein the heat treatment metal product passes through the first passing hole (11); a first coolant distribution pipe (12) provided on the first module housing (10) along an inner circumference of the first module housing (10) and carrying a coolant; and a coolant supply port (14) provided on an outer circumferential surface of the first module housing (10) and connected to the first coolant distribution pipe (12) via a coolant supply pipe (15).

The first module cover (20) comprises: a second passing hole (21) provided in the first module cover (20), wherein the heat treatment metal product passes through the second passing hole (21), wherein the first passing hole (11) of the first module housing (10) and the second passing hole (21) are aligned with each other along a first axis, wherein the heat treatment metal product passes through the first passing hole (11) and the second passing hole (21) along the first axis; and a second coolant distribution pipe (22) provided on the first module cover (20) along an inner circumference of the first module cover (20) and carrying the coolant. The first coolant distribution pipe (12) and the second coolant distribution pipe (22) integrally form a combined coolant distribution pipe (12, 22).

The first nozzle (30) comprises: a first nozzle panel (32) in a disk shape; a third passing hole formed in the first nozzle panel (32), wherein the heat treatment metal product passes through the third passing hole; nozzle grooves (31) provided on the nozzle panel (32) along an inner circumference of the nozzle panel (32).

The first nozzle (30) is fixed by first nozzle fixing blocks (13) protruding from the first coolant distribution pipe (12) and second nozzle fixing blocks (23) protruding from the second coolant distribution pipe (22). The heat treatment metal product is in a round-bar or a pipe shape. The coolant spray module system sprays the coolant onto the heat treatment metal product to quench and clean the heat treatment metal product.

The coolant spray system according to an embodiment of the present invention, further includes: one or more additional coolant spray module, wherein the one or more additional coolant spray module includes a second coolant spray module (1B), wherein the second coolant spray module (1B) has substantially the same structure as the first coolant spray module (1A) and comprises a second module housing (10), a second module cover (20), and a second nozzle (30); first and second module frame connection holes (16) formed at edges of the first and the second module housings (10) of the first and the second coolant spray modules (1A, 1B), respectively; and a module frame (40) configured in a rod shape and inserted into the first and the second module frame connection holes (16). The first, the second, and the third passing holes of the first and the second coolant spray modules (1A, 1B) are aligned with each other along the first axis.

In the coolant spray system according to an embodiment of the present invention, the heat treatment metal product proceeds from an entry location to an exit location along the first axis to pass through the first and the second coolant spray modules (1A, 1B). The first coolant spray module (1A) is located at a first location between the entry location and the exit location. The second coolant spray module (1B) is located at a second location between the first coolant spray module (1A) and the exit location.

The first nozzle panel (32) of the first nozzle (30), which is provided in the first coolant spray module (1A), is angled toward the exit location by a first angle with respect to a perpendicular plane, wherein the perpendicular plane is perpendicular to the first axis. The second nozzle (30) includes a second nozzle panel (32). The second nozzle panel (32) has substantially the same structure as the first nozzle panel (32). The second nozzle panel (32) is angled toward the exit location by a second angle with respect to the perpendicular plane. The first angle is greater than the second angle.

In the coolant spray system according to an embodiment of the present invention, the module frame (40) comprises: a module fixing block (41) provided between the first coolant spray module (1A) and the second coolant spray module (1B) and adjusting a distance between the first coolant spray module (1A) and the second coolant spray module (1B); and a module fixing member (42) provided at an end of the module frame (40).

In the coolant spray system according to an embodiment of the present invention, each of the first and the second coolant distribution pipes (12, 22) of the first coolant spray module (1A) is divided into two or more portions. The two or more portions include an upper pipe and a lower pipe.

The first axis is located at a first level in height. The upper pipe is located at a second level higher than the first level. The coolant is applied to the upper pipe at a first pressure. The lower pipe is located at a third level lower than the first level, wherein the coolant is applied to the lower pipe at a second pressure. The second pressure is maintained greater than the first pressure so that the coolant is sprayed at a uniform pressure from the first nozzle (30) to the heat treatment metal product regardless of the location from which the coolant is sprayed out.

Advantages of Invention

According to an embodiment of the present invention, the coolant can be uniformly sprayed on the surface of the working product, which is in a pipe or a round-bar shape. As a result, the working product is subject to uniform heat treatment effect, and the product quality can be improved.

According to an embodiment of the present invention, nozzles having various inclination angles and thicknesses can be employed and thus spray angles and spray amounts of the coolant which is sprayed onto the surface of the working product, can be easily controlled.

According to an embodiment of the present invention, two or more coolant spray modules are arranged in series. The working product (or working piece) passes through the two or more coolant spray modules in a direction from an entry location to an exit location. The coolant spray module provided at an entry location is configured to spray the coolant toward the exit location.

The closer to the exit location a given coolant spray module is, the smaller the spray angle of the coolant sprayed out from the given coolant spray module is. Such structure prohibits the coolant sprayed out from the coolant spray module from heading wrong direction, rather than spraying onto the working piece, thereby effectively preventing uneven cooling of the product.

According to an embodiment of the present invention, the two or more coolant spray modules are connected to each other by a module frame. A fixing block is provided between the coolant spray modules to adjusting an interval between the coolant spray modules. The range and spray amount of the coolant can be freely controlled using the fixing block.

According to an embodiment of the present invention, a coolant distribution pipe distributes the coolant to the nozzle. The coolant distribution pipe is divided into two or more sections (or portions) to prevent an unwanted pressure drop of the coolant in the coolant distribution pipe.

The gravity effect may cause such unwanted pressure drop. To neutralize the gravity effect, the coolant is provided at a relatively higher pressure into a nozzle located at a higher level in height. Under this structure, the coolant spray pressure can be maintained uniformly regardless of the level at which a given coolant spray module is located.

BEST MODE

Figure 1A:
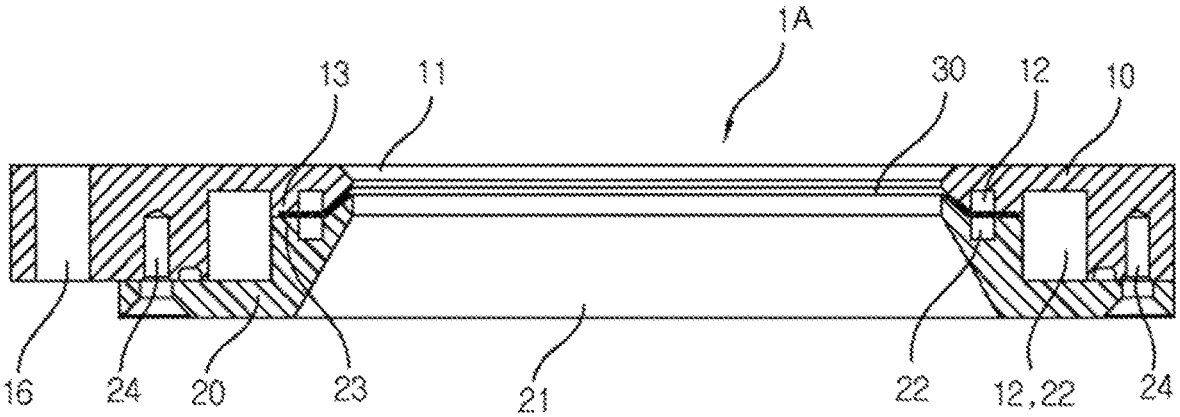
FIGS. 1(*a*) and (*b*) are cross-sectional views showing a coolant spray module according to an embodiment of the present invention in an assembled and a disassembled states.

Hereinafter, embodiments of the present invention will be described with reference to the accompanying drawings.

The present invention will be described in detail with reference to the portions necessary for understanding operation according to the present invention.

Well-known technology in the art which is not directly related to the present invention will be omitted for better clarity.

In the present invention, the same elements may be given different reference numerals in different drawings. However, this does not mean that the element at issue has different functions depending on embodiments. In another instance, the same reference numerals may be cited in different drawings. However, this does not necessarily mean that the element at issue has the same function in the drawings. The function of a given element should be determined based on the description on each embodiment.

Also, the technical terms used in the present specification should be construed in a sense generally understood by a person having ordinary skill in the art to which the present invention belongs, unless otherwise defined in the present specification. They should not be construed either in an overly broad manner or in an overly narrow manner. Furthermore, when a singular term is used herein, it includes plural referents unless the context clearly indicates otherwise.

Hereinafter, a configuration and an operation according to an embodiment of the present invention will be described.

Figure 1B:
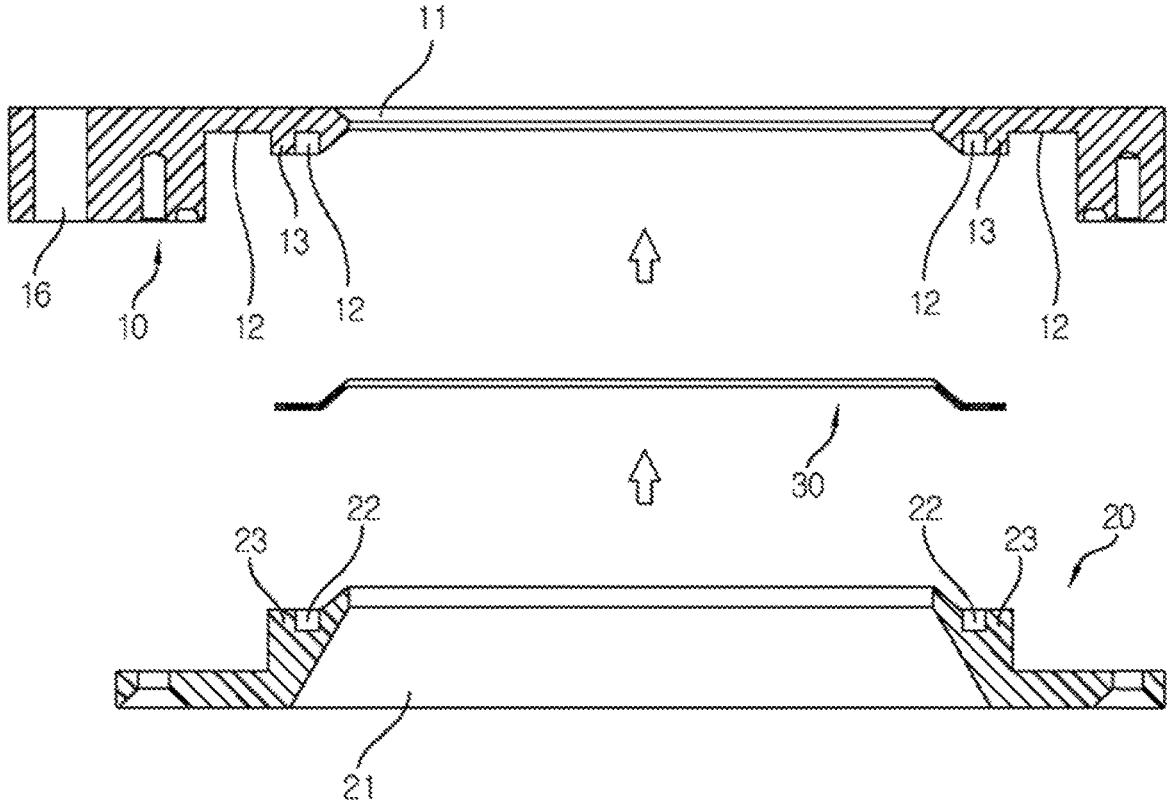
Figure 2A:
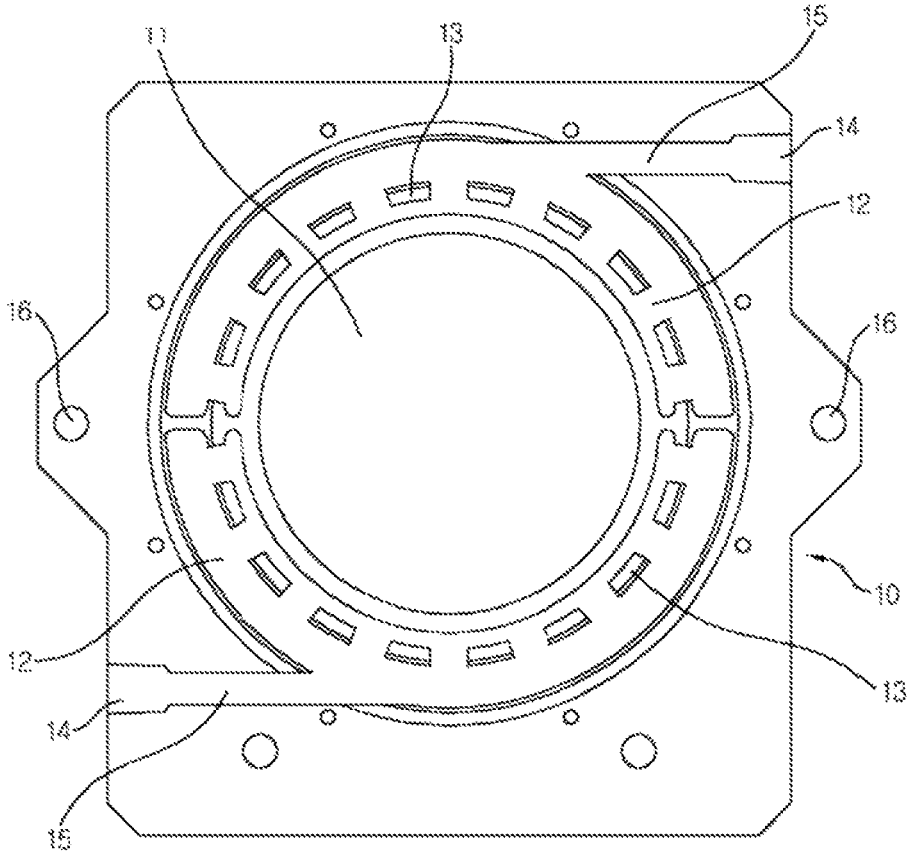
FIGS. 2 (*a*) and (*b*) are plan views of a module housing and a module cover, respectively, according to an embodiment of the present invention.
Figure 2B:
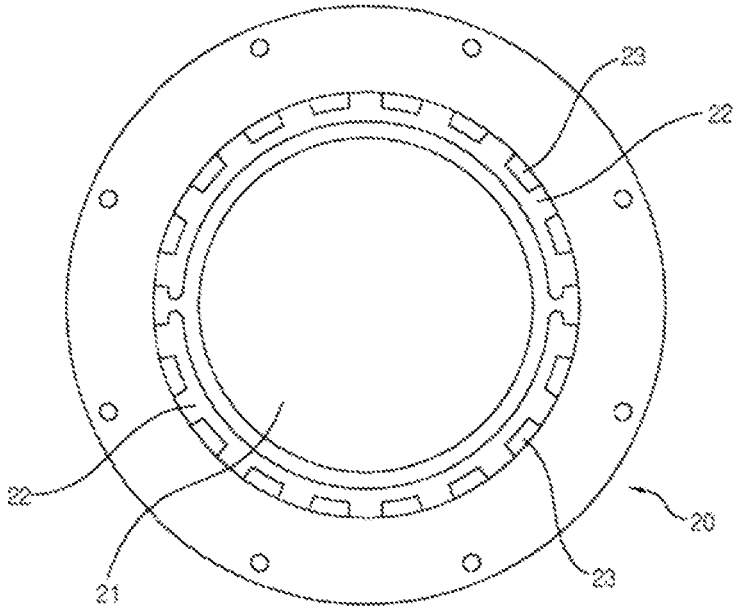

As shown in FIGS. 1 and 2, a first coolant spray module (1A) according to a first embodiment of the present invention includes a first module housing (10) having first and second passing holes (11, 21) through which a working product passes, a first module cover (20) and a first nozzle (30) mounted between the first module housing (10) and the first module cover (20).

A first coolant distribution pipe (12) is formed on the first module housing (10) along an inner circumference of the first module housing (10). The first coolant distribution pipe (12) is in a groove-shaped. A coolant fills in the first coolant distribution pipe (12).

A coolant supply port (14) is formed on an outer circumferential surface of the first module housing (10) and supplies the coolant into the first coolant distribution pipe (12) through a coolant supply pipe (15). The coolant supply pipe (15) is formed inside the first module housing (10) and serves as a coolant passage.

A groove-shaped second coolant distribution pipe (22) is filled with coolant and provided on an outer circumferential surface of the second passing hole (21) of the first module cover (20). The first coolant distribution pipe (12) and the second coolant distribution pipe (22) integrally form a combined coolant distribution pipe (12, 22).

When the first module housing (10) and the first module cover (20) are combined, the center of the first passing hole (11) of the first module housing (10) and the center of the second passing hole (21) of the first module cover (20) are aligned with each other on a first axis along which the work product passes.

First nozzle fixing blocks (13), each in a protrusion shape, are formed on the first coolant distribution pipe (12). Likewise, second nozzle fixing blocks (23), each in a protrusion shape, are formed on the second coolant distribution pipe (22).

The first nozzle (30) is fixed between the first nozzle fixing blocks (13) and the second nozzle fixing blocks (23). The first nozzle (30) is in a disc shape and has a third passing hole in its center. The working product passes through the passing hole.

The first module housing (10) and the first module cover (20) are fixed to each other by a fastening member (24) such as a bolt.

Figure 3A:
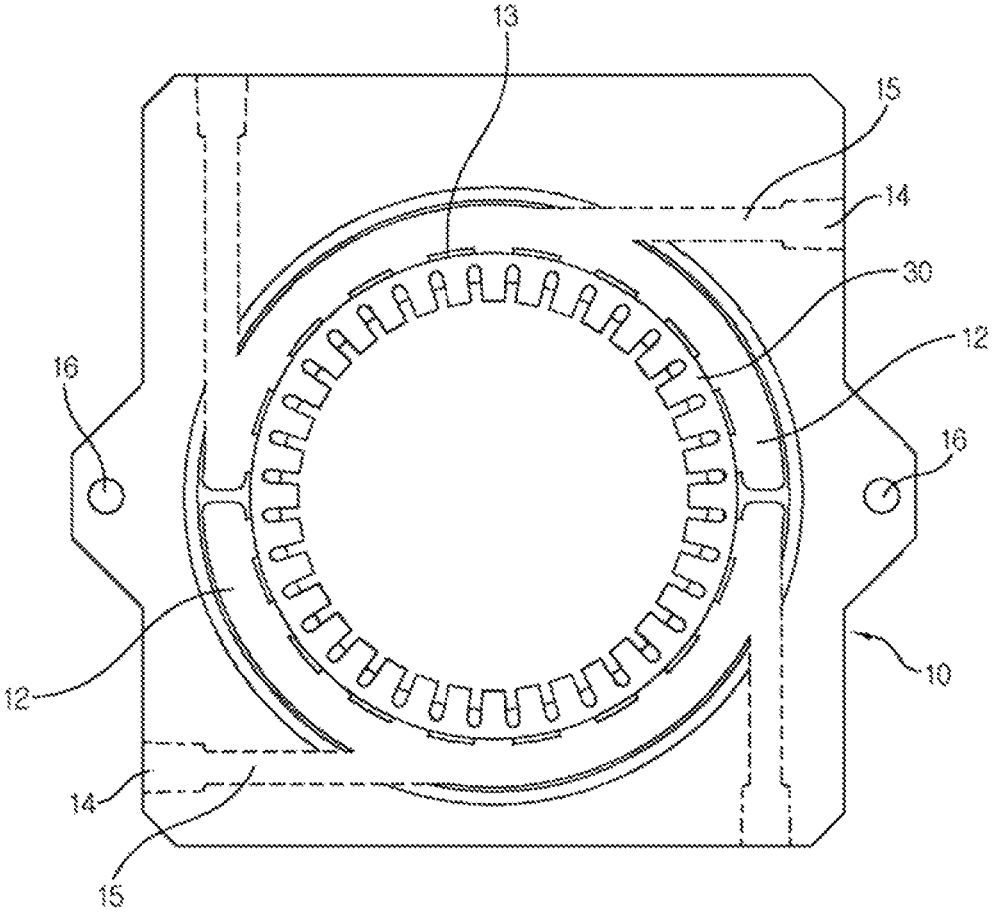
FIGS. 3 (*a*) and (*b*) are plan views of a module housing having a nozzle mounted and a nozzle, respectively, according to the embodiment of the present invention.
Figure 3B:
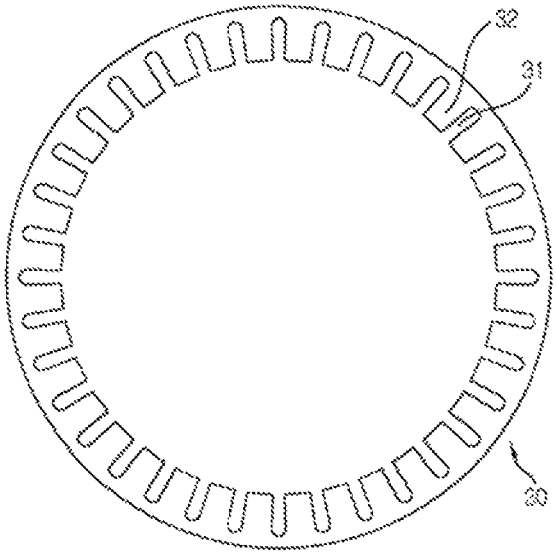

As shown in FIG. 3, the first nozzle (30) includes a first nozzle panel (32) and nozzle grooves (31). The first nozzle panel (32) is in a disk shape. The third passing hole is formed in the first nozzle panel (32). The working product (also referred to as "heat treatment metal product" or "working piece") passes through the third passing hole. The nozzle grooves (31) are provided on the nozzle panel (32) along an inner circumference of the nozzle panel (32).

When the heat treatment product enters the first and second passing holes (11, 21) of the first coolant spray module (1A), the coolant is supplied to the coolant supply port (14) formed on the circumferential side of the first module housing (10). The coolant supplied to the coolant supply port (14) is distributed into the first and second coolant distribution pipes (or the combined coolant distribution pipes) (12, 22) through the coolant supply pipe (15).

The dispensed coolant is delivered to the nozzle grooves (31) of the first nozzle (30) and sprayed out from an end of the nozzle panel (32) to the working product to perform quenching and cleaning. The first nozzle (30) is fixed by the first and second nozzle fixing blocks (13) and (23). The first and second nozzle fixing blocks (13) and (23) are formed on the first and second coolant distribution pipes (12, 22), respectively.

According to the first embodiment, the center of the nozzle (30) is aligned with the center of the first passing hole (11) of the first module housing (10) and the center of the second passing hole (21) of the first module cover (20) along the first axis. Since the center of the first nozzle (30) is located on the first axis along which the pipe-shaped or the round bar-shape working product proceeds, the coolant can be uniformly sprayed out from the first nozzle (30) onto the entire surface of the working product. Thus, quenching of the working product can be uniformly performed, and product quality improves.

Figure 4:
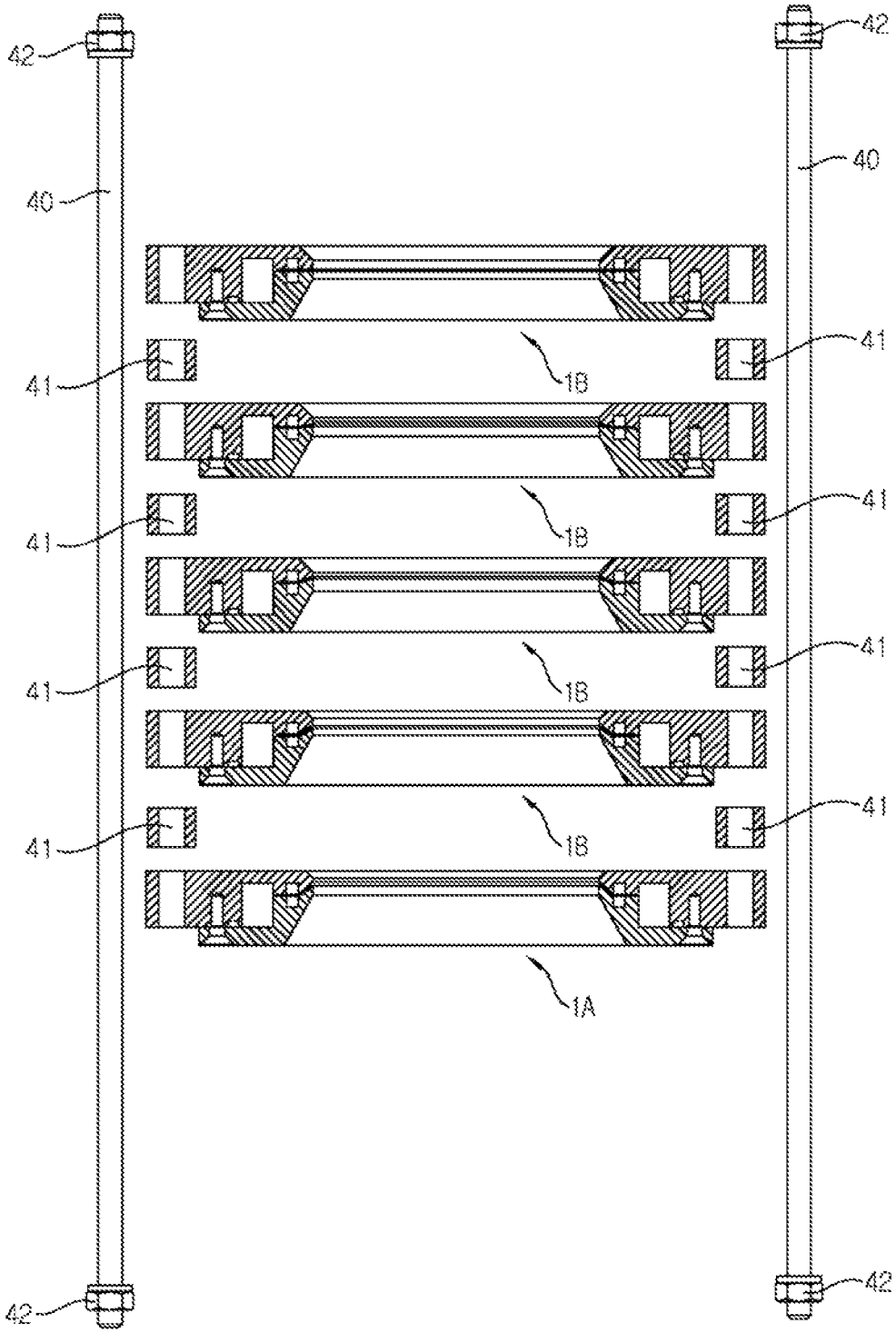
FIGS. 4 and 5 are views showing a combined structure of a module frame, a module fixing block, and a module fixing member according to an embodiment of the present invention. Two or more coolant spray modules are coupled together in series.
Figure 5:
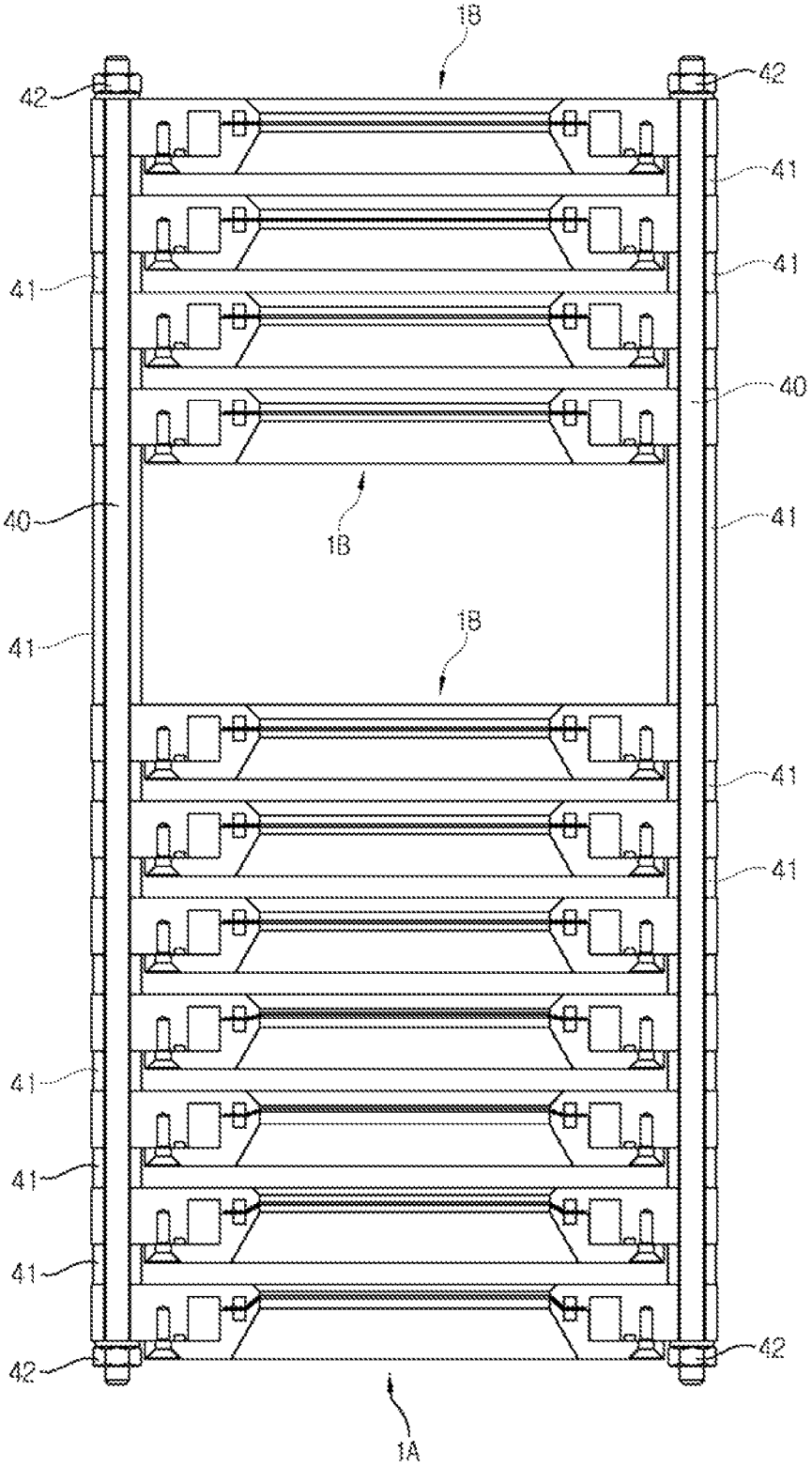

A second embodiment of the present invention includes all elements of the first coolant spray module (1A) mentioned in the first embodiment. As shown in FIGS. 4 and 5, the second embodiment of the present invention further includes one or more additional coolant spray module. The one or more additional coolant spray module includes a second coolant spray module (1B). The second coolant spray module (1B) has substantially the same structure as the first coolant spray module (1A) and includes a second module housing (10), a second module cover (20), and a second nozzle (30). First and second module frame connection holes (16) are formed at edges of the first and the second module housings (10) of the first and the second coolant spray modules (1A, 1B), respectively.

A module frame (40), which is configured in a rod shape, is inserted into the first and the second module frame connection holes (16) so that the first coolant spray module (1A) and the second coolant spray module (1B) are aligned with each other along the first axis. Under this structure, the coolant can be uniformly sprayed out from the first and the second coolant spray modules (1A, 1B) onto the entire surface of the working product, improving a quenching speed of the work product.

Figure 6:
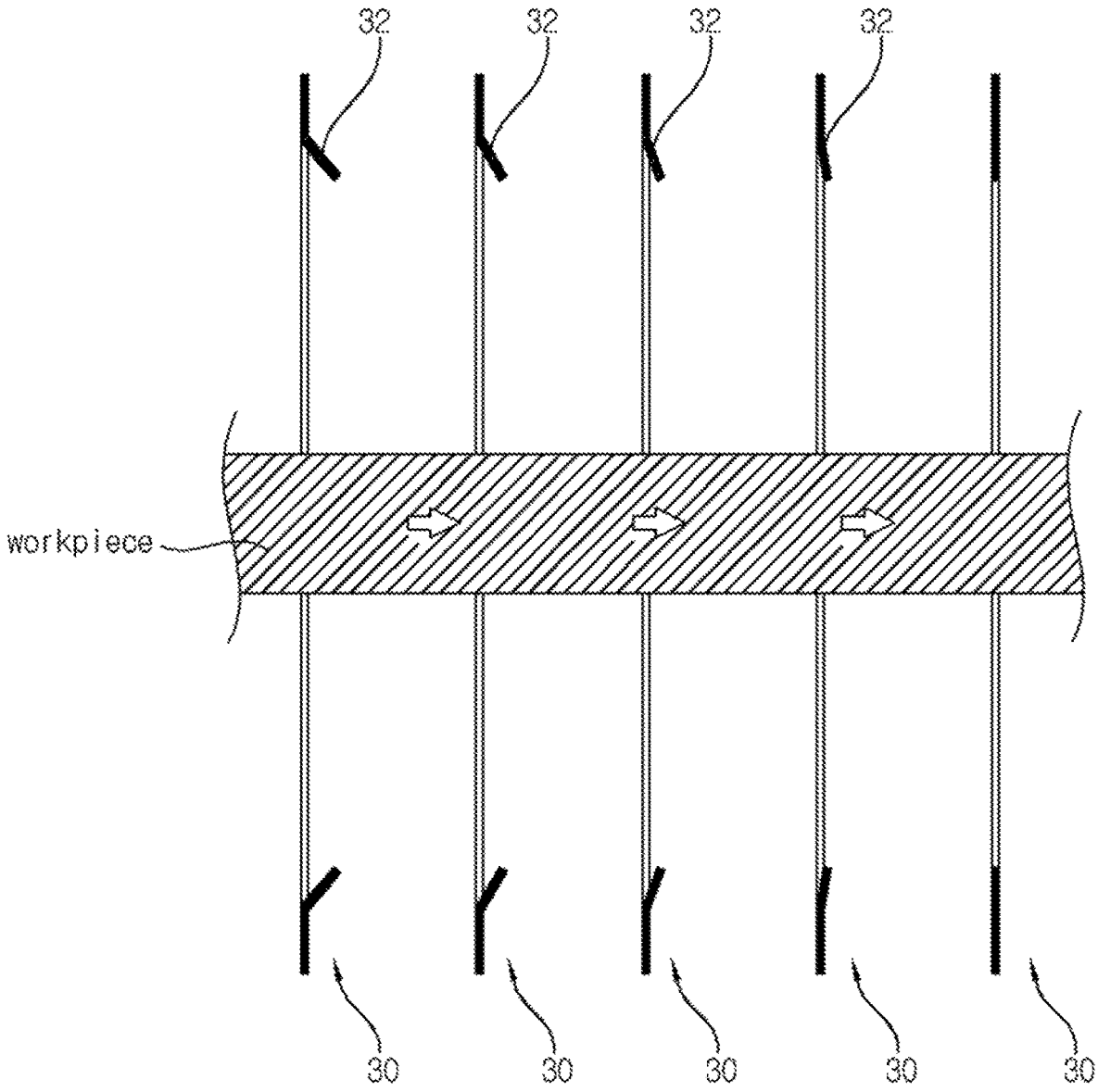
FIG. 6 is a cross-sectional view showing a product passing between nozzles according to the embodiment of the present invention. The nozzles panels have different inclination angles depending on location.
Figure 7:
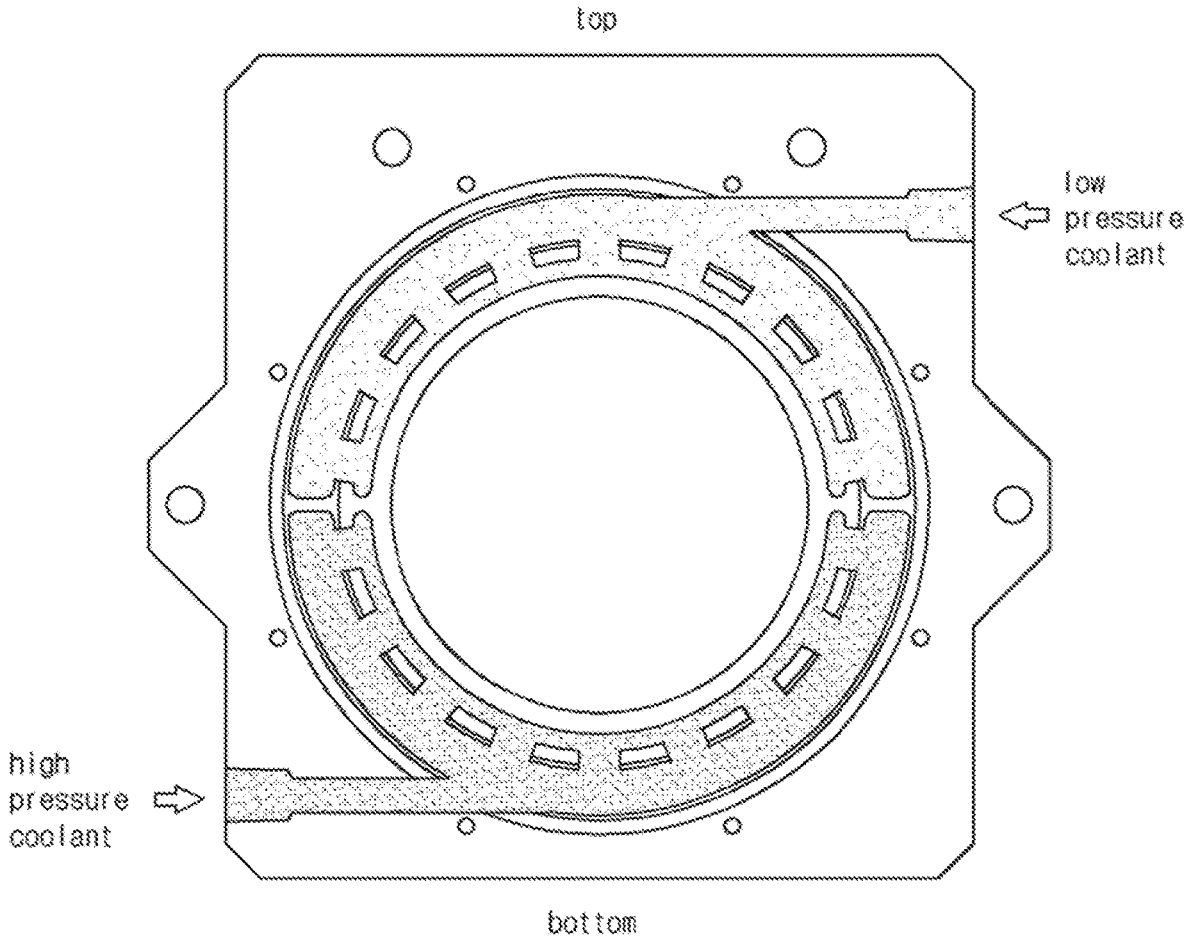
FIG. 7 is a cross-sectional view a coolant spray module according to an embodiment of the present invention. Two or more coolant distribution pipes are formed in the coolant spray module. A relatively higher pressure applies to a coolant supplied into a coolant distribution pipe located at a relatively lower level.

A third embodiment of the present invention includes all elements of the first and the second coolant spray modules (1A, 1B) mentioned in the second embodiment. As shown in FIG. 6, the nozzle panels (32) of the respective nozzles (30) mounted on the two or more coolant spray modules are formed at different inclination angles so that the inclination angle of the nozzle panel (32) gradually changes.

The heat treatment metal product, i.e., the work product, proceeds from an entry location to an exit location along the first axis. The first coolant spray module (1A) is located at a first location between the entry location and the exit location. The second coolant spray module (1B) is located at a second location between the first coolant spray module (1A) and the exit location. The first nozzle panel (32) of the first coolant spray module (1A) is angled toward the exit location by a first angle with respect to a perpendicular plane. The perpendicular plane is perpendicular to the first axis. The second nozzle (30) includes a second nozzle panel (32). The second nozzle panel (32) has substantially the same structure as the first nozzle panel (32). The second nozzle panel (32) is angled toward the exit location by a second angle with respect to the perpendicular plane. The first angle is greater than the second angle.

Due to such structure, when the work product passes through the first and the second coolant spray modules (I A, 1B), it is possible to prevent the coolant from randomly splashing out in an unintended direction. The first and second nozzles (30) can be replaced with other nozzles having various thicknesses. The coolant spray amount can be easily controlled by such nozzle replacement.

A fourth embodiment of the present invention includes all elements of the first and the second coolant spray modules (1A, 1B) mentioned in the second embodiment. As shown in FIGS. 4 and 5, a module fixing block (41) is provided between the first coolant spray module (1A) and the second coolant spray module (1B) and adjusts a distance between the first coolant spray module (1A) and the second coolant spray module (1B). The module fixing block (41) may have a various length.

When the first and the second coolant spray modules (1A, 1B) and the module fixing block (41) are in place, a module fixing member (42) is provided at an end of the module frame (40) to fix the first and the second coolant spray modules (1A, 1B). Through such fixing process, a spray range can be freely adjusted.

A fifth embodiment of the present invention includes all elements of the first and the second coolant spray modules (1A, 1B) mentioned in the first embodiment or in the second embodiment. The combined coolant distribution pipe (12, 22) is coupled to a coolant supply port (14) through a coolant supply pipe (15) so that a coolant is supplied to the combined coolant distribution pipes (12, 22). The combined coolant distribution pipe (12, 22) of each of the first and the second coolant spray modules (1A, 1B) is divided into two or more portions (or sections).

For example, the combined coolant distribution pipe (12, 22) of the first coolant spray module (1A) may be divided into an upper pipe and a lower pipe. When the first axis is located at a first level in height, the upper pipe may be located at a second level higher than the first level while the lower pipe is located at a third level lower than the first level. The coolant is applied to the upper pipe at a first pressure, and the coolant is applied to the lower pipe at a second pressure. The second pressure is maintained greater than the first pressure.

A sixth embodiment of the present invention has substantially the same structure as shown in the fifth embodiment. It is preferable that the ratio of the first pressure:the second pressure is 8.5:10.5 to 9.5:11.5.

A cooling rate required and a coolant spray amount required may be different depending on a given working products. Accordingly, the coolant pressure can controlled differently to meet a given cooling rate and a given coolant spray amount.

In conventional art, due to gravity effect, a flow rate/flow amount of the coolant in the upper pipe is lower than a flow rate/flow amount of the coolant in the lower pipe when the coolant is sprayed out onto the working product. Thus, the quenching occurs in an uneven manner depending on the location of the first nozzle (30), more specifically, depending on the height level on which the first nozzle (30) is located. The present invention can solve this problem by spraying the coolant at different pressures depending on the location of the spraying level, that is, the location of the combined coolant distribution pipes (12, 22).

While the embodiments of the present invention have been described with reference to the above-mentioned embodiments, it should be understood to the persons having an ordinary skill in the art that the present invention may be modified without departing from its spirit and scope. It should be understood that all embodiments described above are illustrative and not restrictive. The scope of the present invention is determined by the following claims. All changes or modifications of each element of this invention and its equivalent should be construed as being included within the scope of the present invention.

EXPLANATION OF SYMBOLS

1A: first coolant spray module
10: first module housing
11: first passing hole
12: first coolant distribution pipe
13: first nozzle fixing blocks
14: first and second coolant supply port
15: first and second coolant supply pipes
16: first and second module frame connection holes
20: first module cover
21: second passing hole
22: second coolant distribution pipe
23: second nozzle fixing block
12, 22: combined coolant distribution pipe
24: fastening member
30: first nozzle
31: nozzle grooves
32: nozzle panel
40: module frame
41: module fixing block
42: Module fixing member

What is claimed is:

1. A coolant spray module system for a heat treatment metal product, comprising:

a first coolant spray module (1A), wherein the first coolant spray module (1A) comprises a first module housing (10), a first module cover (20), and a first nozzle (30), wherein the first module housing (10) comprises:

a first passing hole (11) provided in the first module housing (10), wherein the heat treatment metal product passes through the first passing hole (1);

a first coolant distribution pipe (12) provided on the first module housing (10) along an inner circumference of the first module housing (10); and a coolant supply port (14) provided on an outer circumferential surface of the first module housing (10) and connected to the first coolant distribution pipe (12) via a coolant supply pipe (15), wherein the first module cover (20) comprises:

a second passing hole (21) provided in the first module cover (20), wherein the heat treatment metal product passes through the second passing hole (21), wherein the first passing hole (11) of the first module housing (10) and the second passing hole (21) are aligned with each other along a first axis, wherein the heat treatment metal product passes through the first passing hole (11) and the second passing hole (21) along the first axis; and a second coolant distribution pipe (22) provided on the first module cover (20) along an inner circumference of the first module cover (20), wherein the first coolant distribution pipe (12) and the second coolant distribution pipe (22) are integrated together to form a combined coolant distribution pipe (12, 22), wherein the combined coolant distribution pipe (12, 22) carries a coolant, wherein the first nozzle (30) comprises:

a first nozzle panel (32) in a disk shape;

a third passing hole formed in the first nozzle panel (32), wherein the heat treatment metal product passes through the third passing hole; and nozzle grooves (31) provided on the nozzle panel (32) along an inner circumference of the nozzle panel (32), wherein the first nozzle (30) is fixed between the first module housing (10) and the first module cover (20) by first nozzle fixing blocks (13) and second nozzle fixing blocks (23), wherein the first nozzle fixing blocks (13) protrudes from the first coolant distribution pipe (12), wherein the second nozzle fixing blocks (23) protrudes from the second coolant distribution pipe (22), wherein the heat treatment metal product is in a round-bar shape or a pipe shape, wherein the coolant spray module system sprays the coolant onto the heat treatment metal product to quench and clean the heat treatment metal product.

2. The coolant spray system of claim 1, further comprising:

one or more additional coolant spray module, wherein the one or more additional coolant spray module includes a second coolant spray module (1B), wherein the second coolant spray module (1B) has substantially the same structure as the first coolant spray module (1A) and comprises a second module housing (10), a second module cover (20), and a second nozzle (30);

first and second module frame connection holes (16) formed at edges of the first and the second module housings (10) of the first and the second coolant spray modules (1A, 1B), respectively; and a module frame (40) configured in a rod shape and inserted into the first and the second module frame connection holes (16), wherein the first, the second, and the third passing holes are aligned with each other along the first axis.

3. The coolant spray system of claim 2, wherein the heat treatment metal product proceeds from an entry location to an exit location along the first axis to pass through the first and the second coolant spray modules (1A, 1B), wherein the first coolant spray module (1A) is located at a first location between the entry location and the exit location, wherein the second coolant spray module (1B) is located at a second location between the first coolant spray module (1A) and the exit location, wherein the first nozzle panel (32) of the first nozzle (30), which is provided in the first coolant spray module (1A), is angled toward the exit location by a first angle with respect to a perpendicular plane, wherein the perpendicular plane is perpendicular to the first axis, wherein the second nozzle (30) includes a second nozzle panel (32), wherein the second nozzle panel (32) has substantially the same structure as the first nozzle panel (32), wherein the second nozzle panel (32) is angled toward the exit location by a second angle with respect to the perpendicular plane, wherein the first angle is greater than the second angle.

4. The coolant spray system of claim 2, wherein the module frame (40) comprises:

a module fixing block (41) provided between the first coolant spray module (1A) and the second coolant spray module (1B) and adjusting a distance between the first coolant spray module (1B) and the second coolant spray module (1B); and a module fixing member (42) provided at an end of the module frame (40).

5. The coolant spray system of claim 1, wherein the combined coolant distribution pipe (12, 22) of the first coolant spray module (1A) is divided into two or more portions, wherein the two or more portions include an upper pipe and a lower pipe, wherein the first axis is located at a first level in height, wherein the upper pipe is located at a second level higher than the first level, wherein the coolant is applied to the upper pipe at a first pressure, wherein the lower pipe is located at a third level lower than the first level, wherein the coolant is applied to the lower pipe at a second pressure, wherein the second pressure is maintained greater than the first pressure so that the coolant is sprayed out at a uniform pressure from the first nozzle (30) to the heat treatment metal product regardless of the location from which the coolant is sprayed out.

* * * * *